US005637448A

United States Patent [19]

Nakamura et al.

[11] Patent Number: 5,637,448

[45] Date of Patent: Jun. 10, 1997

[54] SILVER HALIDE LIGHT-SENSITIVE PHOTOGRAPHIC MATERIAL

[75] Inventors: Masaki Nakamura; Nobuaki Kagawa, both of Hino, Japan

[73] Assignee: Konica Corporation, Japan

[21] Appl. No.: 706,738

[22] Filed: Sep. 9, 1996

Related U.S. Application Data

[63] Continuation of Ser. No. 489,303, Jun. 9, 1995, abandoned.

[30] Foreign Application Priority Data

Jun. 17, 1994 [JP] Japan ..... 6-135993

[51] Int. Cl.[6] ..... G03C 1/18

[52] U.S. Cl. ..... 430/588

[58] Field of Search ..... 430/585, 588

[56] References Cited

U.S. PATENT DOCUMENTS

| | | | |
|---|---|---|---|
| 3,854,955 | 12/1974 | Shiba et al. | 430/550 |
| 4,657,846 | 4/1987 | Kokubo et al. | 430/585 |
| 5,198,332 | 3/1993 | Ikegawa et al. | 430/585 |

*Primary Examiner*—Lee C. Wright

*Attorney, Agent, or Firm*—Jordan B. Bierman; Bierman, Muserlian and Lucas LLP

[57] ABSTRACT

A silver halide light-sensitive photographic material is disclosed. The material comprises a layer containing light-sensitive silver halide comprising a sensitizing dye represented by the general formula I:

I wherein $W_1$ is a fluorine-substituted alkyl group. The spectral sensitivity in the short wavelength region of green light is enhanced and color staining due residual dye is reduced.

9 Claims, No Drawings

SILVER HALIDE LIGHT-SENSITIVE PHOTOGRAPHIC MATERIAL

This application is a continuation of application Ser. No. 08/489,303, filed Jun. 9, 1995, now abandoned.

INDUSTRIAL FIELD OF THE INVENTION

The present invention relates to a silver halide light-sensitive photographic material, which is herein after referred to as "light-sensitive material", having an enhanced optical sensitivity in the short wavelength region of green light and reduced residual color strain of the sensitizing dye.

BACKGROUND OF THE INVENTION

It is well-known in the art when a certain kind of dye is added to an silver halide emulsion(herein after referred to as "silver halide emulsion" or, simply "emulsion"), sensitivity wavelength region of the emulsion is expanded and optical sensitivity is increased.

As the dye used for this purpose, a lot of compounds are known in the art, and, for example, variety of dyes such as hemicyanine dyes, cyanine dyes, merocyanine dyes and xanthene dyes, which are disclosed on pages 194 to 234 of "The Theory of the Photographic process" 4th edition, written by T. H. James published by Mcmilan Ltd. in 1977 and on pages 441 et seq. in "The Chemistry of Heterocyclic Compounds", vol. 30, written by D. M. Starmer, published by John Wiley & Sons, New York, in 1977, are known.

It is necessary for these optical sensitizing dyes not only to expand sensitive wavelength region of the silver halide emulsion but also to satisfy the following conditions.

(1) Optical sensitizing region is appropriate.

(2) Optical sensitizing efficiency is high.

(3) There is no advertent interaction between other photographic additives such as a stabilizer, an anti-foggant, a coating aid, a high boiling point solvent, etc.

(4) They do not have advertent effects on the shape of the characteristic curve, such as occurrence of fog or fluctuation of gamma, etc.

(5) When a silver halide light-sensitive material containing the dye is stored, especially under high temperature and high humidity conditions, they do not cause changes in the photographic properties such as occurrence of fog.

(6) The added dye does not diffuse into a different layer having different optical sensitivity and causes color stain there.

(7) After the photographic material undergoes photographic process, such as development, fixing, rinsing, etc., the dye is sufficiently removed from the system and does not cause color contamination.

However, those sensitizing dyes known in the art do not satisfy all these conditions.

Incidentally, it is known in the art that the human eye has its highest visual sensitivity to green light and, therefore, subtle balance in the green-light has a great effect on the color hue. Therefore, is demanded that a silver halide light-sensitive color photographic material has sufficient sensitivity in the green-light region, that it has appropriate spectral sensitivity and that the dye can be removed sufficiently after processing.

And, in the light-sensitive materials for shooting, it is understood to be appropriate that spectral sensitivity of the green light-sensitive layer is in the wavelength region between 500 to 600 nm and the weighted average of the optical sensitivity maximum resides approximately about 540 nm.

That is to say, in order for the realization of the appropriate spectral sensitivity distribution, it is necessary for the wavelength region between 500 and 540 nm to be spectrally sensitized satisfactorily as well as in the region of longer wavelength.

Up to today, a lot of patents have been disclosed and as those in which a single kind of dye is used, for example, oxacarbocyanine dyes disclosed in U.S. Pat. Nos. 2,072,908, 2,647,053; British Patent No. 1,012825; benzimidazolocarbocyanine dyes disclosed in Japanese patent Publication Nos. 38-7828(1963), 43-14497(1968; British Patent No. 815,172; U.S. Pat. Nos. 2,778,823, 2,7639,149, 2,912,329 and 3,656,959; and oxathiacarbocyanine dyes disclosed in British Patent No. 1,012825 are known.

Further, techniques of hyper sensitization, in which an oxacarbocyanine dye is employed together with different types of dye, are disclosed in, for example, Japanese Patent Publication Nos. 43-4936(1968), 43-22884(1968), 44-32753(1969), 46-11627(1971), 48-25652(1973), 57-14834(1982) and Japanese Patent O.P.I. Publication No. 3-48235(1991).

However, with these dyes, although green-sensitivity is enhanced, good color reproduction property may not be obtainable as the spectral sensitivity region shifts to longer wavelength region.

As the sensitizing dyes used for spectrally sensitizing the wavelength region shorter than 550 rim, for example, benzimidazoloxacarbocyanine dyes disclosed in Japanese Patent Publication No. 44-14030(1969) and Japanese Patent O.P.I. Publication No. 51-31228(1976); cyanine dyes disclosed in U.S. Pat. Nos. 2,072,908 and 2,231,658; and dimethinemerocyanine dyes disclosed in U.S. Pat. Nos. 2,493,748, 2,5198,001 and 3,480,439 are known. However, when these dyes are used singly, an emulsion having enhanced spectral sensitivity in the shorter green wavelength region and, particularly a photographic emulsion having high sensitivity at the wavelength region of 540 nm or shorter can hardly be obtainable, and there is a problem that, upon attempt to enhance sensitization, fog tends to be caused easily and storage preservation property tends to be deteriorated. Still further, with the use of oxacarbocyanine dyes disclosed in, for example, U.S. Pat. Nos. 2,521705, 2,521959 and 2,647,054, which have their sensitivity maxima in the wavelength region between 530 and 540 run, there are, again defects that attainable sensitivity is relatively low and that remarkable color staining due to residual dyes takes place.

Oxacarbocyanine dyes having a sulfoalkyl group as a substituent on a nitrogen position of its molecular structure, disclosed in Japanese Patent O.P.I. Publication No. 63-163843(1988) and oxacarbocyanine dyes having a bulky substituent, as disclosed in Japanese Patent O.P.I. Publication No. 63-163843(1988) can, in comparison with the carbocyanine dyes known to date, shift the spectral sensitivity maxima towards shorter wavelength side and exert improvement in the photographic properties, however, spectral sensitivity in the wavelength region shorter than 540 nm is insufficient and, therefore, further improvement in this respect has been demanded.

As for dyes which have a fluorine atom as a substituent, symmetric carbocyanines having a monofluorine substituent or a trifluoromethyl-substituent have already been known in Japanese Patent O.P.I. Publication No. 48-76525(1973). However, although this type of dye has an effect of shifting its absorption maximum towards shorter wavelength region than 540 nm, spectral sensitivity is insufficient and, still further, asymmetrical oxacarbocyanine dyes have been known in Japanese Patent O.P.I. Publication No. 63-259554 (1988),this type of dye has a defect that due to the presence of a methoxy group maximum spectral sensitivity region becomes in the wavelength region longer than 540 nm.

On the other hand, since the total processing time has been shortened and elimination of washing or rinsing or recycling of the processing solutions has become popular, the dyes tend to remain more easily and, as a result, a new problem of devaluation of the light-sensitive materials arises and, thus, improvement in the pollution by the residual dye has become one of the important items for improvement.

SUMMARY OF THE INVENTION

Accordingly, the objects of the present invention is, firstly, to provide a silver halide light-sensitive photographic material of which spectral sensitivity in the short wavelength region of green light is enhanced and, secondly, to provide a silver halide light-sensitive photographic material, of which spectral sensitivity in the short wavelength region of green light is enhanced and by which color staining due to residual dye is reduced.

A silver halide light-sensitive photographic material of the invention comprises a silver halide emulsion layer on a support, wherein the layer silver halide emulsion contains a sensitizing dye represented by the formula I;

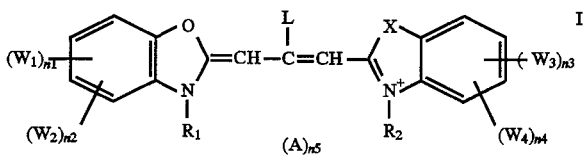

I

In the general formula, W1 represents a fluorine-substituted alkyl group; $W_2$, $W_3$ and $W_4$ independently represent a group selected from the group consisting of an aliphatic group, an aromatic group, a halogen atom, an acylamino group, a carbamoyl group, a carboxyl group, a sulfonamide group and a sulfamoyl group;

n represents an integer of one or two and $n_2$, $n_3$ and $n_4$ independently represent an integer of zero, one or two;

$R_1$ and $R_2$ independently represent an aliphatic group or an aromatic group, provided that they may be either same or different;

X represents an oxygen atom or an alkyl-substituted nitrogen atom;

L represents a hydrogen atom or an alkyl group;

A represents a counter ion which is necessary to neutralize the ion charge of the molecule and $n_5$ represents zero or one.

According to one of the preferable embodiments of the present invention, X in the general formula I is an oxygen atom.

According to one other preferable embodiments of the present invention, X in the general formula I is a trifluoromethyl group.

DETAILED DESCRIPTION OF THE INVENTION

The sensitizing dye represented by the formula I is explained.

In the general formula I, $W_1$ represents an alkyl group substituted by a fluorine and therein the alkyl group contains one to eight carbon atoms at least one fluorine may be substituted. Preferably, —$CHF_2$, —$CF_3$, —$CF_2CHF_2$, —$C_3HF_6$, and —$C_3F_7$ can be mentioned. Still more preferably, —$CF_3$ can be mentioned.

As for $W_2$, $W_3$ and $W_4$, an aliphatic group containing one to six carbon atoms, for example, a straight chain or branched alkyl group containing one to six carbon atoms such as methyl group, ethyl group, propyl group, butyl group or hexyl group; an alkenyl group containing three to six carbon atoms, such as 2-propenyl group, 3-butenyl group, 1-methyl-3-propenyl group, 3-pentenyl group and 1-methyl-3-butenyl group; an aralkyl group containing seven to ten carbon atoms, such as benzyl group and phenetyl group; can be mentioned. As for the aromatic group, for example, a substituted or unsubstituted aryl group containing six to twelve carbon atoms, such as a phenyl group, a toluyl group and a chlorophenyl group can be mentioned. Further, a halogen atom such as fluorine atom, chlorine atom, bromine atom, etc.; a carbamoyl group such as carbamoyl group, N-methylcarbamoyl group, N,N-tetramethylenecarbamoyl group; an acylamino group such as acetylamino group, benzoylamino group, etc.; a carboxyl group; a sulfonamide group such as methanesulfonamide group, butansulfonamide group, etc.; a sulfamoyl group such as acetamidosulfonyl group, methoxyacetamidosulfonyl group, etc. can be mentioned.

As for the aliphatic group represented by $R_1$ and $R_2$, for example, an unsubstituted or substituted alkyl group containing one to five carbon atoms and an aralkyl group containing seven to ten carbon atoms can be mentioned. As for the aromatic group, for example, an unsubstituted or substituted aryl group containing seven to ten carbon atoms can be mentioned. As the substituent therefore, for example, a sulfo group, a carboxyl group and hydroxide group can be mentioned. Moreover, $R_1$ and $R_2$ may be either same or different, it is preferable that at least one of $R_1$ and $R_2$ has at least one substituent. In view of satisfying both effects of spectral sensitization and reduction of color staining due to residual dye, a compound, in which at least one of $R_1$ and $R_2$ in the general formula I contains a water solibilising group such as a sulfo group or a carboxyl group is much more advantageous. The most preferable example of the water solibilising group is a sulfo group.

As for specific examples of $R_1$ and $R_2$, for example, carboxymethyl group, carboxyethyl group, sulfoethyl group, sulfopropyl group, sulfobutyl group, 3-sulfobutyl group, sulfopentyl group, 3-sulfo-2-hydroxylpropyl group, ω-sulfopropoxycarbonylmethyl group, ω-sulfopropylaminocarbonylmethyl group, 3-sulfinobutyl group, hydroxyethyl group, N-methylureylenemethyl group, N-methanesulfonylcarbamoylmethyl group, 4-sulfo-3-butenyl group, 2-carboxy-2-propenyl group, o-sulfobenzyl group, p-sulfophenetyl group and p-carboxybenzyl group can be mentioned. The more preferable embodiment is that at least one of $R_1$ and $R_2$ is selected from the examples mentioned above.

As the alkyl group in the nitrogen atom having an alkyl substituent represented by X represents an alkyl group containing one to six carbon atoms. Specifically, for example, methyl group, ethyl group, propyl group, iso-propyl group, n-butyl group, sec-butyl group, iso-pentyl group, hexyl group and cyclohexyl group can be mentioned. The preferable examples are a methyl group, an ethyl group, a propyl group and an iso-propyl group.

The alkyl group represented by L stands for an alkyl group containing one to eight carbon atoms. Specifically, methyl group, ethyl group, propyl group, iso-propyl group, sec-butyl group, iso-pentyl group, hexyl group and cyclohexyl group can be mentioned.

A represents an cation or an anion. As specific examples of cation includes, for example, proton, an organic ammonium ion such as triethylammonium, triethanolammonium, etc.; an inorganic cation, for example, lithium ion, sodium ion and calcium ion can be mentioned. Specific examples of anion include, for example, an organic sulfonic acid ion, such as p-toluenesulfonic acid ion, benzenesulfonic acid ion; an organic sulfinic acid such as benzenesulfinic acid; an organic carboxylic ion such as benzoic acid ion, acetic acid ion; an inorganic anion such as a chloride ion, nitrate ion, hypochlorous acid ion and fluoroborate ion, etc. can be mentioned. $n_5$ represents zero or one, provided that when an intra-molecular salt is formed and electric charge is neutralized, it represents zero.

Specific examples of the sensitizing dyes represented by the general formula I are shown below, however, the sensitizing dye which is used for the present invention are not limited to these compounds:

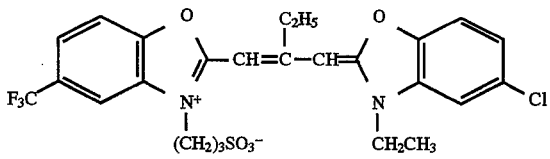

I-1

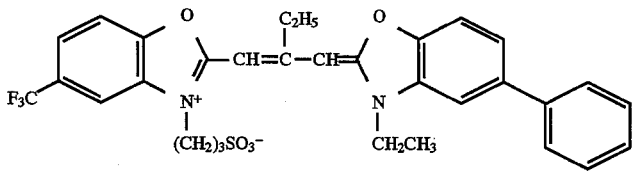

I-2

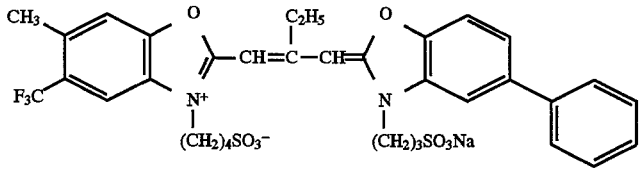

I-3

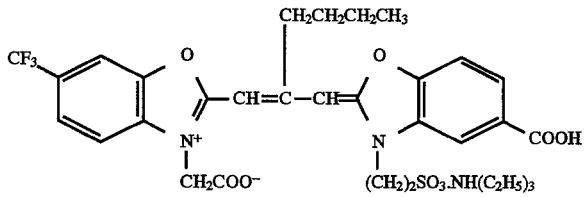

I-4

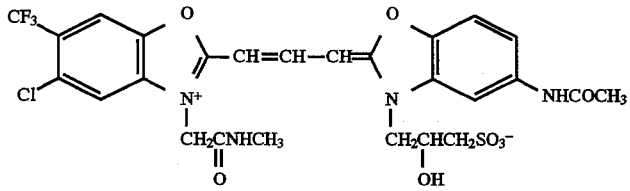

I-5

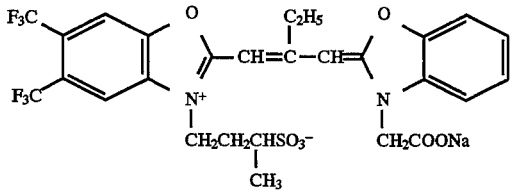

I-6

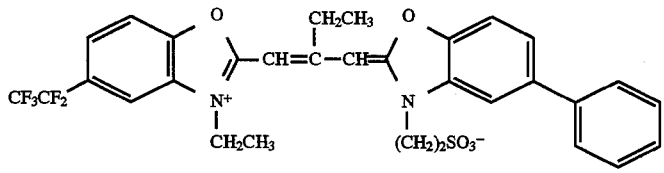

I-7

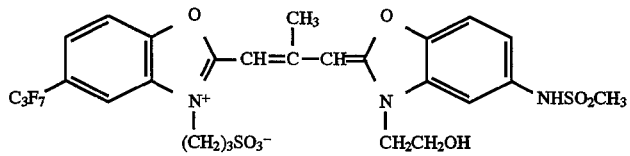

I-8

-continued
I-9
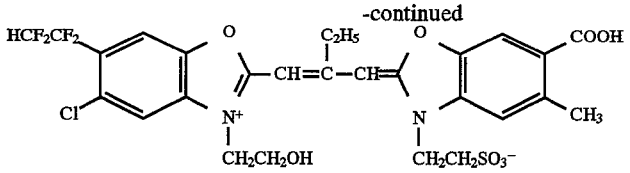
I-10
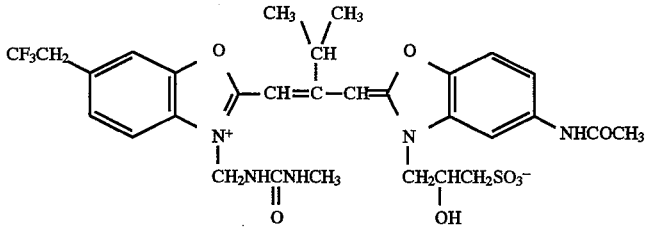
I-11
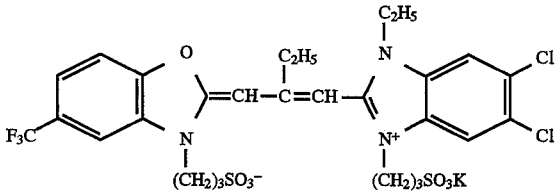
I-12
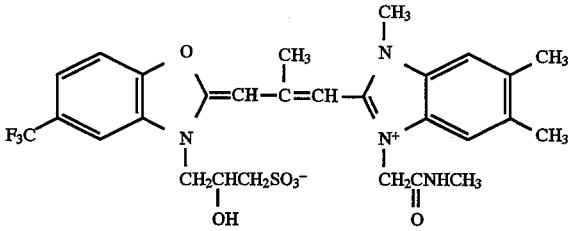
I-13
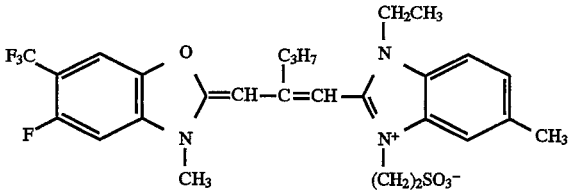
I-14
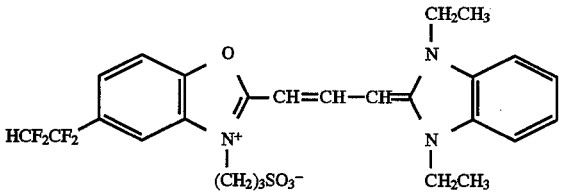
I-15
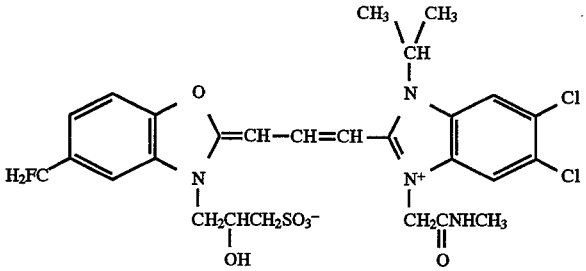
I-16
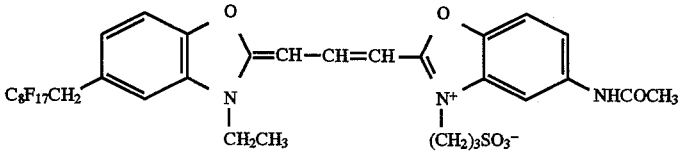

The sensitizing dyes used in the present invention can be synthesized by a person skilled in the art with reference to the manners described in, for example, "Cyanine Dyes and Related Compounds", written by F. M. Hammer, published by Inter-Science publishers Ltd. in 1964.

Synthesis examples are given below; other compounds related to the present invention may be synthesized in the similar manners.

SYNTHESIS EXAMPLE 1 (Synthesis of I-1)

After stirring 5 g (0.025 mols) of 2-methyl-5-trifluoromethylbenzoxazole, 3 g (of 1,3-propanesultone and 100 ml of cresol for two hours under heat, 13.5 ml (0.075 mols) of triethyl orthopropionate was added at 90° C. and stirred for 15 minutes. Reactant solution was added to 300 ml of diisopropylether to cause precipitation and after the top clear part was removed by decantation. To the thus obtained precipitation product 10 ml of cresol and 9.2 g (0.025 mols) of 2-methyl-3-ethyl-5-chlorobenzoxazolium p-toluenesulfonate was added, and when the mixture became 110° C., triethylamine 10 ml was added and reacted for 15 mins. After cooling the reactant solution 300 ml of iso-propylether was added to the reactant solution to cause precipitation. After the top clear part was removed by decantation, the product was refined by a column chromatography, to obtain 3.7 g of dye.

λmax: 495 nm ε: $14.4\times10^4$ (methanol)

SYNTHESIS EXAMPLE 2 (Synthesis of I-2)

4.5 g of dye was obtained in the same manner as Synthesis Example 1, except that in this example, 10.2 (0.025 tools) of 2-methyl-3-ethyl-5-phenylbenzoxazolium p-toluenesulfonate was used in place of 2-methyl-5-chlorobenzoxazolium p-toluenesulfonate.

λmax: 499 nm ε: $15.5\times10^4$ (methanol)

Amount of addition of the sensitizing dye used in the present invention can be varied depending upon the conditions of use or the nature of the emulsion to be used, preferably between $1\times10^{-6}$ and $5\times10^{-3}$ mols and, more preferably between $2\times10^{-6}$ and $2\times10^{-3}$ mols a mol of silver halide.

The compound represented by the above-mentioned general formula I can be added to the silver halide emulsion according to conventional manners which are well known in the art. For example, a protonation solubilization method disclosed in Japanese Patent O.P.I. Publication Nos. 50-80826(1875) and 50-808279(1975); a method of dispersing and adding together with a surface active agent disclosed in U.S. Pat. Nos. 3,822,135 and Japanese Patent O.P.I. Publication Nos. 50-80826(1875) and 50-114199(1975); a method of dispersing in a hydrophilic substrate and adding as disclosed in U.S. Pat. Nos. 3,676,147, 3,469,987 and 4,247,627; Japanese Patent O.P.I. Publication Nos. 51-59942(1876), 53-16624(1978), 53-102732(1978).53-102733(1978) and 53-137131(1978); a method of addition in the form of a solid solution as disclosed in East German Patent No. 143,324 or a method of solubilizing in a water-miscible low boiling-point solvent such as water, methanol, ethanol, propylalcohol, acetone or a fluorinated alcohol or a high boiling-point solvent such as dimethylformamide, methylcellosolve, phenylcellosolve, etc. or a mixture thereof and add to the emulsion which is disclosed in the Research Disclosure No. 21,802; Japanese Patent Publication No. 50-40659(197) and Japanese Patent O.P.I. Publication No. 59-148053(1984) may optionally be selected.

The time of addition of the sensitizing dye represented by the above-mentioned general formula I may be at any time during the manufacturing steps of the emulsion i.e., between initiation of physical ripening and completion of chemical ripening and coating, however, it is preferable that the dye is added between initiation of physical ripening and completion of chemical ripening.

Addition of the sensitizing dye used in the present invention during physical ripening or prior to the addition of chemical sensitizing agents in the chemical ripening step has an effect of causing higher sensitivity and is, therefore, preferable.

The sensitizing dye used in the present invention can exert further enhanced sensitization effect by using together with a compound which is capable of bringing about hyper-sensitization. As for such compounds capable of bringing about hyper-sensitization, for example, compounds having a pyrimidinylamino group or a triazinylamino group disclosed in U.S. Pat. Nos. 2,933,390, 3,416,927, 3,511,664, 3,615,613, 3,615,632 and 3,635,721; Japanese patent O.P.I., Publication Nos. 3-15042(1991),3-110545(1991 and 4-255841 (1992); aromatic organic formaldehyde condensation products disclosed in British Patent No. 1,137,580 and Japanese patent O.P.I. Publication No. 61-169833(1986); calixarene derivatives disclosed in Japanese Patent O.P.I. Publication No. 4-184332(1992); halogenized benzotriazole derivatives disclosed in U.S. Pat. No. 4,030,927; bis-pyridinium compounds disclosed in Japanese Patent O.P.I. Publication Nos. 59-142541(1984) and 59-188641(1992); aromatic heterocyclic quarternary salts disclosed in Japanese Patent O.P.I. Publication No. 59-191032(1984); electron donating compounds disclosed in Japanese Patent O.P.I, Publication No. 60-79348(1985); polymeric compounds containing a aminoallylidenmalononitrile unit disclosed in U.S. Pat. No. 4,307.183; hydroxytetrazaindene derivatives disclosed in Japanese patent O.P.I. Publication No. 4-14493 (1992); 1,3oxadiazole derivatives disclosed in U.S. Pat. No. 3,615,633 and amino-1,2,3,4-thiatriazole derivatives disclosed in U.S. Pat. No. 4,780,404 can be mentioned. There is no specific limitation as to the time of addition of these hyper-sensitizing compounds and they may optionally be added in accordance with the similar manner with respect to the sensitizing dyes mentioned above. Amount of addition is selected from a range between $1\times10^{-6}$ and $1\times10^{-1}$ mols a mol of silver halide, and the adding proportion against the sensitizing dye may vary within a range between 1/10 and 10/1.

As for the silver halide used in the silver halide emulsion of the silver halide light-sensitive material of the present invention may optionally be selected from the group consisting of silver iodobromide, silver bromide, silver chlorobromide, silver chloroiodobromide, silver chloride and silver chloroiodide. As to the shape of the silver halide grain, one having any optional shape may be used. For example, cubic octahedral, tetradecahedral, spherical or tabular-shape crystals having the aspect ratio greater than five can be used, however, a so-called mono-dispersed grains, of which variation coefficient given in terms of (standard deviation of the grain size)/(average grain size)× 100 is not more than 15%, are preferable. There is no specific limitation as to the average grain size, it is, generally, between 0.05 and 2.0 mm and, preferably between 0.1 and 1.2 μm.

As a hydrophilic protective colloid used for the preparation of the silver halide light-sensitive photographic material of the present invention, in addition to gelatin which is usually used in the silver halide emulsion, gelatin derivatives such as acetylated gelatin and phthalic gelatin or other water-soluble cellulose derivatives and other synthetic or natural hydrophilic polymers are included.

To the silver halide light-sensitive photographic material of the present invention, if necessary, various techniques and additives, which are known in the art, can be applied. For example, in addition to the light-sensitive silver halide emulsion layer, other auxiliary layers such as protective layer, a filter layer, an anti-halation layer, a layer for eliminating cross-over light, a backing layer, etc. can be arranged. In these layers a variety of photographic additives such as a chemical sensitizing agent, a noble-metal sensitizing agent, a dye-forming coupler, a high boiling-point solvent, an anti-foggant, a stabilizer, a development inhibitor, a bleach accelerator, a surface active agent, a fixing accelerator, an anti-color staining agent, a formalin scavenger, a color toning agent, a gelatin hardener, a surface active agent, a viscosity-increasing agent, a plasticizer, a lubricant, an ultraviolet ray absorbent, an anti-irradiation dye, a filtering dye, a polymer latex, a heavy metal, an anti static agent and a matting agent. These additives may be incorporated in the silver halide light-sensitive photographic material of the present invention in various manners. As for the support which can be used in the silver halide light-sensitive photographic material of the present invention, for example, cellulose triacetate, nitro cellulose, polyester such as polyethyleneterephthalate and polyethylene-2,6-naphthalate, polyolefin such as polyethylene, polystyrene, baryta paper, or paper, glass or metal plate laminated with polyethylene, etc. can be mentioned.

These supports may undergo, if necessary an appropriate subbing treatment such as corona discharging or provision of a polymer subbing layer.

These photographic additives mentioned above are disclosed in research Disclosures vol. 176, No. 17643 (December 19780 and Vol. 184 No. 18,431(November 1979).

In order to process the silver halide light-sensitive photographic material of the present invention, developing agents disclosed on pages 291 to 334 in "The Theory of the Photographic process", fourth edition, vol. 4, written by T. H. James, and on page 3,100, vol. 73, (1951) of "The Journal of American Chemical Society" ca advantageously be employed.

EXAMPLES

Herein below, the present invention is further explained with reference to examples.

Example 1

(preparation of Silver Halide Photographic Emulsion)
<Preparation of Era-A>

To a silver iodobromide seed emulsion, containing silver iodobromide grains of which average gain size and silver iodide content are 0.1 μm and 2 mol %, respectively, an aqueous solution containing ammoniacal silver nitrate, an aqueous solution containing potassium iodide and an aqueous solution containing potassium bromide were added by double-jet mixing process, to prepare a silver iodobromide emulsion containing cubic-shaped monodisperse silver iodobromide grains, of which average grain size and average silver iodide content were 0.34 μm and 1.2 mol %, respectively. After removing unnecessary salts from the system using a gelatin derivative treated with phenylisocyanate and flocculation process, the emulsion was dispersed in gelatin. Coefficient of variation (σ/92 ) of this emulsion was 0.17.

After adjusting pH and pAg of the thus prepared emulsion were adjusted at 5.8 and 7.0, respectively using citric acid and sodium chloride, sensitizing dyes as shown in Table 1 were added, and after undergoing an optimum degree of chemical ripening at 60° C. with ammonium thiocyanate, sodium thiocyanate hexa-hydrate and auric chloride, the ripening was ceased by adding 600 mg a mol of silver of 4-hydroxy-6-methyl-l,3,3a,7tetrazaindene.

<Preparation of Em-B>

Using the same seed emulsion mentioned above and after growing silver halide grains by adding an aqueous solution containing silver nitrate, an aqueous solution containing potassium bromide and an aqueous solution containing potassium chloride, unnecessary salts were removed by the flocculation process using a gelatin derivative modified by phenylisocyanate and thus prepared emulsion was dispersed in gelatin, to prepare an silver halide emulsion containing cubic-shaped mono-disperse silver iodochloride gains of which average grain size, silver chloride content, silver iodide content and coefficient of variation were 0.35 μm, 70 mol %, 0.5 mol % and 0.1, respectively.

After adjusting pH and pAg of the thus prepared emulsion were adjusted at 5.8 and 7.0, respectively using citric acid and sodium chloride, sensitizing dyes as shown in Table 1 were added, and after undergoing an optimum degree of chemical ripening at 60° C. with ammonium thiocyanate, sodium thiocyanate hexa-hydrate and auric chloride, the ripening was ceased by adding 600 mg a mol of silver of 4-hydroxy-6-methyl-l,3,3a,7tetrazaindene.

(Preparation of a Silver Halide Light-Sensitive photographic Material)

Preparation of photographic support

On one side of polyethyleneterephthalate having coated on both side with 10 wt % aqueous emulsified dispersion glycidylmethacrylate/methylacrylate/butylmethacrylate copolymer (50/10/40 weight ratio) as subbing layers, a backing layer coating composition containing 2 g/m$^2$ equivalent of a dye-emulsified dispersion consisting of 400 g of gelatin, 2 g of polymethacrylate particles having the average particle size of 6 μm, 24 g of potassium nitrate, 6 g of sodium dodecylbenzenesulfonate and 24 g of 2:2:1 mixture of anti-halation dyes consisting of F-1, F-2 and F-3 and glyoxal hardener, a protective layer coating composition containing gelatin, matting agent glyoxal and dodecylbenzenesulfonic acid were coating simultaneously. The amount of coating was 2.0 g/m$^2$ as converted into coated amount of gelatin with respect to both the protective layer and the backing layer Sample Nos. 1 through 20 were prepared by simultaneously coating a silver halide emulsion layer and a protective layer, of which compositions are given below, on a support with the above-mentioned backing layer by the use of a slidehopper-type coating machine, Herein, the coated amount of the silver halide emulsion layer converted into the amount of silver was 3.0 g/m$^2$, and the amount of gelatin was 2.5 g/m$^2$ with respect to the silver halide emulsion layer and 1.2 g/m$^2$ with respect to the protective layer.

F-1

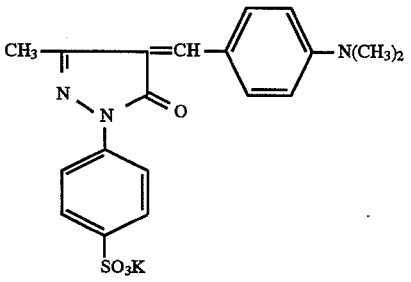

F-2

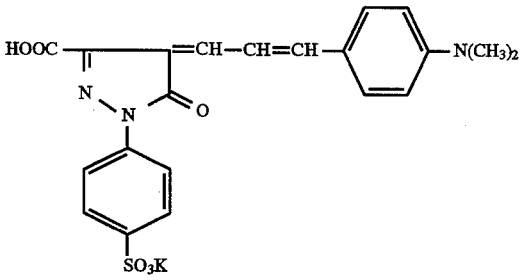

F-3

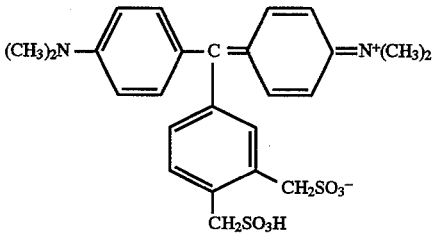

Composition (1): Silver Halide Emulsion Layer

| | |
|---|---|
| Gelatin | 2.5 g/m$^2$ |
| Silver halide emulsion A or B | 3.0 g/m$^2$ |
| Nitrophenyl-triphenylphosphonium chloride | 30 mg/mol AgX |
| Ammonium 1,3-dihydroxybenzene-4-sulfonate | 1.0 mg/mol AgX |
| Sodium 2-mercaptobenzimidazole-5-sulfonate | 10 mg/mol AgX |
| 2-Mercaptobenzothiazole | 10 mg/mol AgX |
| Trimethylol propane | 9.0 g/mol AgX |
| 1,1-Dimethylol-1-bromo-1-nitromethane | 10 mg/mol AgX |
| $C_4H_9OCH_2N(CH_2COOH)_2$ | 1.0 g/mol AgX |
| Restrainer: | |
| ST-1 | 35 mg/mol AgX |
| ST-2 | 60 mg/mol AgX |

ST-1

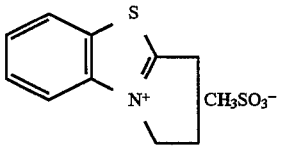

-continued

ST-2

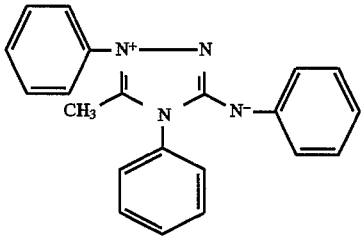

Composition (2): Protective Layer

| | |
|---|---|
| Gelatin: lime-treated inert gelatin; 97 and Acid-treated gelatin: 3 | 1.2 g/m$^2$ |
| Surface Active Agent: SA-1 (Sodium i-pentyldecyl sulfosuccinate | 1.0 g/l |
| Matting Agent: 4 mm polymethylmethacrylate particles and Silica particles of 1.2 μm | 0.5 g/l |
| ludox AM (Colloidal silica produced by du Pont) | 30.0 g/l |
| Hardener: 1,3-vinylsulfonyl-2-propanol (2% aqueous solution) | 10.0 ml/l |
| Formalin (35% aqueous solution) | 2.0 ml/l |
| Glyoxal (40% aqueous solution) | 1.5 ml/l |

Samples thus obtained are shown in Table 1.

Evaluation of Photographic Properties

Respective samples thus obtained were divided into two groups and one of the respective samples was placed in close touch with an optical wedge(Y-48, a product of Toshiba Glass Ltd.), through which the sample was subjected to exposure. With respect to the samples of another group, they were subjected to light exposure through a interference filter to light having its weighted average wavelength at 520 nm. These samples were, then, processed in a rapid processor SR-X-520, a product of Konica Corporation, in which a developing solution XD-SR and a fixing solution XF-SR, both produced by Konica Corporation, are installed. Thus obtained samples were subjected to density measurement in a conventional method using an optical densitometer PDA-65, a product of Konica corporation, to obtain relative sensitivities of the samples by calculating reciprocals of light exposure which gives the samples the fog density plus 0.3. Thus relative sensitivity of the respective samples were obtained, while sensitivity of Sample No. 13 was normalized as 100.

Moreover, degree of color stains due to residual dye was investigated by measuring the amount of remaining sensitizing dye by thin-layer chromatography, after condensed and extracted solution, which is a mixed solvent made of water and methanol and in which unexposed sample films, which have been subjected to development and fixing processes, were dipped for one hour in a dark room. Results were divided into five ranks, in which 5 is the highest, leaving no residual dye at all, to 1, which is worst.

Results are shown in Table 1.

<Preparation of processing solutions>

(Developing Solution A)

| Part-A | |
|---|---|
| Potassium hydroxide | 1140 g |
| Potassium sulfite | 2451 g |
| Sodium hydrogencarbonate | 380 g |

-continued

| | |
|---|---|
| Boric acid | 38 g |
| Diethylene glycol | 418 g |
| Pentasodium diethylenetriamine-penta-acetate | 61 g |
| 5-Methylbenzotriazole | 1.9 g |
| Hydroquinone | 1064 g |
| Add water to make the total volume | 9.3 liters |
| Part-B (for 38 liters) | |
| Glacial acetic acid | 562 g |
| Triethylene glycol | 418 g |
| 1-Phenyl-3-pyrazolidone | 100 g |
| 5-Nitroindazole | 9.5 g |

Manner of mixing of the respective parts:

20 liters of 25° C. water was added into a 50-liter-volume tank and while stirring it Part-A was added. Then Part-B was added. Finally, water was added to make the total volume 38 liters. After leaving the solution for 24 hours at 25° C., pH of this solution was adjusted with potassium hydroxide or acetic acid at 10.53.

(Starter)

| | |
|---|---|
| Glacial acetic acid | 230 g |
| potassium bromide | 200 g |

Add water to make the total volume 1.5 liters

As the replenisher, the above-mentioned developing solution was used as it is, and in the in the solution in the developing bath at the at the initiation of processing the above-mentioned initiator was added at a proportion of 20 ml a liter of the developing solution and used. Development replenisher was used at a quantity of 250 ml a square meter of Sample.

(Composition of the Fixing Solution)

| | |
|---|---|
| Part-A (for the final 38 liters) | |
| Ammonium thiosulfate | 6080 g |
| Di-Sodium ethylenediaminetetracetic acid tetrahydrate | 0.76 g |
| Sodium sulfite | 456 g |
| Boric acid | 266 g |
| Sodium hydroxide | 190 g |
| Glacial acetic acid | 380 g |
| Add water to make the total volume | 9.5 liters. |
| Part-B (for the final 38 liters) | |
| Aluminium sulfate (converted as anhydride) | 380 g |
| Sulfuric acid (50 wt. %) | 228 g |
| Add water to make the total volume | 1.9 liters. |

Manner of mixing of the respective parts:

20 liters of 25° C. water was added into a 50-liter-volume tank and while stirring it Part-A was added. Then Part-B was added. Finally, water was added to make the total volume 38 liters pH of this solution was adjusted with acetic acid at 4,30 at 25° C.(A13+content is 58.5 mols a liter of the fixing solution.

<Development>

Development process was carried out using a processor (SRX-502) and the above-mentioned developing and fixing solutions at 35° C. (development) and at 33° C. (fixing) for 45 seconds.

TABLE 1

| Sample No. | Sensitizing Dye Kind | Sensitizing Dye Amount* | Relative Sensitivity Green Filter | Relative Sensitivity Interference Filter | Degree of Residual Color |
|---|---|---|---|---|---|
| 1 | I-1 | 4.5 | 92 | 128 | 4.0 |
| 2 | I-1 | 7.0 | 98 | 135 | 3.5 |
| 3 | I-2 | 4.5 | 98 | 125 | 4.0 |
| 4 | I-2 | 7.0 | 107 | 134 | 3.5 |
| 5 | I-5 | 4.5 | 92 | 124 | 4.0 |
| 6 | I-5 | 7.0 | 97 | 130 | 3.5 |
| 7 | I-9 | 4.5 | 83 | 113 | 4.5 |
| 8 | I-9 | 7.0 | 89 | 118 | 4.0 |
| 9 | I-11 | 4.5 | 78 | 110 | 4.0 |
| 10 | I-11 | 7.0 | 85 | 118 | 3.5 |
| 11 | I-14 | 4.5 | 80 | 114 | 3.0 |
| 12 | I-14 | 7.0 | 85 | 118 | 2.5 |
| 13 | A | 4.5 | 100 | 100 | 2.0 |
| 14 | A | 7.0 | 108 | 107 | 1.5 |
| 15 | B | 4.5 | 30 | 50 | 4.0 |
| 16 | B | 7.0 | 32 | 45 | 3.5 |
| 17 | C | 4.5 | 87 | 72 | 1.5 |
| 18 | C | 7.0 | 93 | 78 | 1.0 |
| 19 | D | 4.5 | 65 | 50 | 2.0 |
| 20 | D | 7.0 | 73 | 60 | 1.5 |

Note

*: Shown in terms of $\times 10^{-4}$ mols a mol of silver

As it is obvious from Table 1, the silver halide light-sensitive photographic material according to the present invention has excellent anti-color staining property in comparison with the comparative samples and give improved photographic properties, maintaining enhanced spectral sensitivity without raising fog density.

In the examples, chemical structures of the comparative sensitizing dyes are as follows:

Comparative Sensitizing Dyes

A

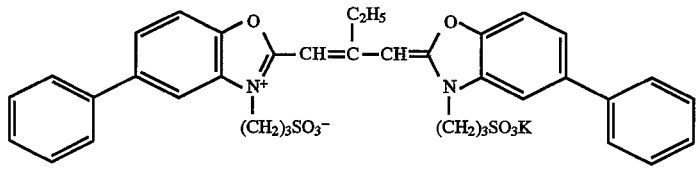

-continued

Comparative Sensitizing Dyes

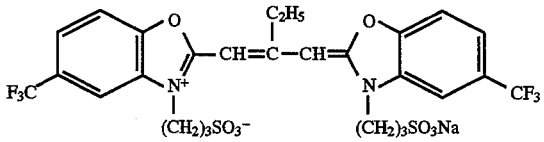

B

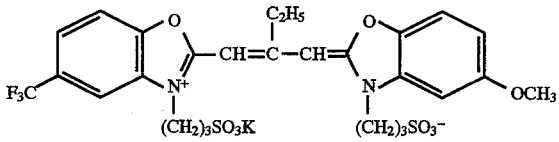

C

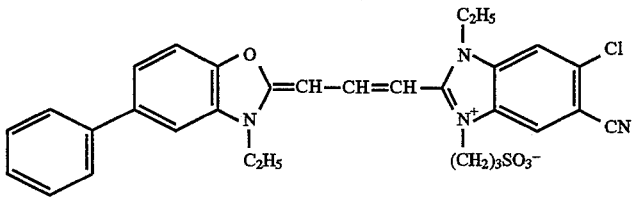

D

Example 2

Herein below, the amount of addition of the photographic additives are given, unless suggested otherwise, in terms of weight a square meter of the silver halide light-sensitive material, provided that the amounts of silver halide and that of colloidal silver are given in terms of equivalent amount of silver and that the amount of the sensitizing dye is given in terms of mol amount a mol of silver halide contained in the same layer.

(Preparation of silver halide photographic emulsion)

<Preparation of a Seed Emulsion>

| | |
|---|---|
| <Solution $A_1$> | |
| Ossein gelatin | 100 g |
| Potassium nitrate | 2.05 g |
| Add water to make the total volume | 11.5 l |
| <Solution $B_1$> | |
| Ossein gelatin | 55 g |
| Potassium bromide | 65 g |
| Potassium iodide | 1.8 g |
| 0.2-N Sulfuric acid | 38.5 ml |
| Add water to make the total volume | 2.6 l |
| <Solution $C_1$> | |
| Ossein gelatin | 75 g |
| Potassium bromide | 950 g |
| Potassium iodide | 27 g |
| Ass water to make the total volume | 3.0 l |
| <Solution $D_1$> | |
| Silver nitrate | 95 g |
| Add water to make the total volume | 2.7 l |
| <Solution $E_1$> | |
| Silver nitrate | 1410 g |
| Add water to make the total volume | 3.2 l |

To <Solution $A_1$>, which was maintained at 60° C. in a reaction vessel, <Solution $B_1$> and <Solution $D_1$> were added by a controlled double-jet mixing method taking 30 minutes and, thereafter, <Solution $C_1$> and <Solution $E_1$> were added by the controlled double-jet mixing method, taking 105 minutes.

Addition of the solutions were carried out at a rate by which generation of new nuclei does not take place and which causes so-called Ostwald's ripening with the growth of the silver halide grains. pAg and pH of the solution at the time of addition of silver ion and halide ion was adjusted with an aqueous potassium bromide solution and sulfuric acid at 8.3±0.05 and 2.0±0.1, respectively.

After completion of addition, in order to remove surplus salts in the mixture, desalination process with reference to a method disclosed in Japanese Patent Publication No. 35-86 (1960) was carried out.

From electron microscopic observation it was found that the silver halide emulsion thus prepared was a monodisperse emulsion containing cubic-shape of which corners are slightly chipped, tetradecahedral silver halide grains, of which average grain size and grain size distribution were 0.27 μand 17%, respectively.

<Preparation of Em-C>

Using Seed Emulsion-1 and seven kinds of solutions given below, a monodisperse core/shell-type emulsion was prepared.

| | |
|---|---|
| <Solution $A_2$> | |
| Ossein gelatin | 10 g |
| Ammoniacal water (28%) | 28 ml |
| Glacial acetic acid | 3 ml |
| Seed Emulsion-1 | 0.119 mol equivalent |
| Add water to make the total volume | 11.5 l |
| <Solution $B_2$> | |
| Ossein gelatin | 0.8 g |
| Potassium bromide | 5 g |
| Potassium iodide | 3 g |
| Add water to make the total volume | 110 ml |
| <Solution $C_2$> | |
| Ossein gelatin | 2.0 g |
| Potassium bromide | 90 g |
| Add water to make the total volume | 240 ml |
| <Solution $D_2$> | |
| Silver nitrate | 9.9 g |
| Ammoniacal water (28%) | 7.0 ml |
| Add water to make the total volume | 110 ml |
| <Solution $E_2$> | |
| Silver nitrate | 130 g |
| Ammoniacal water (28%) | 100 ml |
| Add water to make the total volume | 165 ml |

-continued

| | |
|---|---|
| <Solution $F_2$> | |
| Potassium bromide | 94 g |
| Add water to make the total volume | 165 ml |
| <Solution $G_2$> | |
| Silver nitrate | 9.9 g |
| Ammoniacal water | 7.0 ml |
| Add water to make the total volume | 110 ml |

While maintaining its temperature at 40° C., <Solution $A_2$> was stirred at 800 r.p.m. pH of <Solution $A_2$> was adjusted at 9.90 with acetic acid. Seed emulsion-1 was taken and dispersed therein. Then <Solution G2> was added taking seven minutes and adjusted pAg at 7.3. Further <Solution $B_2$> and <Solution $D_2$> were added simultaneously taking 20 minutes during the addition pAg was kept at 7.3. Further after pH and pAg of the solution were adjusted with an aqueous solution containing potassium bromide and acetic acid at 8.83 and 9.0, respectively, <Solution $C_2$> and <Solution $E_2$> were added simultaneously spending 30 minutes.

Herein, ratio of the amount of flowing was 1:10 and the flow rate was increased with lapse of time Moreover, pH was lowered from 8.83 to 8.00 in proportion to the increase of the flowing rate. When two thirds of the whole amount of <Solution $C_2$> and <Solution $E_2$> were added, <Solution $F_2$> was additionally added at a constant flowing rate spending 8 minutes, when pAg was went up from 9.0 to 11.0 and pH was adjusted at 6.0 with acetic acid.

After completion of the addition, for the purpose of removing surplus salts, precipitation desalination was carried out using an aqueous solution containing Demol, a product of Kao Atlas Co. Ltd. and an aqueous solution containing magnesium sulfite, to obtain a silver halide emulsion of which average silver iodide content, pH and pAg were about 2.0 mol 5.85 and 8.5, respectively at 40° C.

From electron microscopic observation, it was found that the silver halide emulsion thus obtained was a monodisperse core/shell-type emulsion containing slightly round-shaped tetradecahedral silver halide grains, of which average grain size and the width of grain size distribution were 0.55 μm and 14%, respectively.

<Preparation of Seed Emulsion-2>

Seed Emulsion-2 was prepared as follows:

| | |
|---|---|
| <Solution $A_3$> | |
| Ossein gelatin | 24.2 g |
| Water | 9657 ml |
| Polyoxypropylene-polyoxyethylen-sodium-disuccinate (10% aqueous ethanol solution) | 6.87 ml |
| Potassium bromide | 10.8 g |
| 10% nitric acid | 114 ml |
| <Solution $B_3$> | |
| Aqueous solution of 2.5-N silver nitrate | 2825 ml |
| <Solution $C_3$> | |
| Potassium bromide | 824 g |
| Potassium iodide | 23.5 g |
| Add water to make the total volume | 2825 l |

<Solution $D_3$>

Aqueous solution of 1.75-N potassium bromide amount necessary to control silver potential as described below.

Using a mixing stirrer as shown in Japanese Patent publication No. 58-58288(1983) and 58-58289(1983), 464.3 ml each of <Solution $B_3$> and <Solution $C_3$> were added to <Solution $A_3$> by simultaneous mixing method taking two minutes, to cause nucleation.

After stopping addition of <Solution $B_3$> and <Solution $C_3$>, temperature of <Solution $A_3$> was raised to 60° C. taking 60 minutes and, then, after adjusting pH at 5.0 with 3% aqueous solution of potassium hydroxide, 464.3 ml each of <Solution $B_3$> and <Solution $C_3$> were added at the flowing rate of 55.4 ml/min for 42 minutes.

Silver potential, which was measured using a silver ion selective electrode with a saturated silver-silver chloride electrode as a comparative electrode, during the time, while the temperature of the solution was raised from 35° C. to 60° C. and the second simultaneous addition of <Solution $B_3$> and <Solution $C_3$> was made, was adjusted at +8 mv and +16 mv, respectively with <Solution $D_3$>.

After completion of the addition, pH of the solution was adjusted at 6 with an 3% aqueous solution of potassium hydroxide and, immediately thereafter, desalination and washing were carried out. From electron microscopic observation, it was found that this seed emulsion containing silver halide grains, not less than 90% of the total projection area of which consists of hexagonal tabular-shaped grains with maximum neighboring side ratio, average thickness and the average grain size are, between 1.0 and 2.0, 0.06 μm and 0.59 μm, respectively.

<Preparation of Emulsion-D>

Using Seed Emulsion-2 and three kinds of solutions shown below, a silver halide emulsion containing tabular grains was prepared.

| | |
|---|---|
| <Solution $A_4$> | |
| Ossein gelatin | 5.26 g |
| Sodium polyoxypropylene-polyoxyethylen-disuccinate (10% aqueous ethanol solution) | 1.4 ml |
| Seed Emulsion-2 | 0.094 mols equivalent |
| Add water to make the total volume | 569 ml |
| <Solution $B_4$> | |
| Ossein gelatin | 15.5 g |
| Potassium bromide | 114 g |
| Potassium iodide | 3.19 g |
| Add water to make the total volume | 889 ml |
| <Solution $C_4$> | |
| Silver nitrate | 166 g |
| Add water to make the total volume | 889 ml |

<Solution $D_3$>

1.75-N aqueous solution containing potassium bromide amount necessary to adjust the silver potential as shown below:

Using a mixing stirrer as shown in Japanese Patent publications No. 58-58288(1983) and 58-58289(1983), 464.3 ml each of <Solution $B_3$> and <Solution $C_3$> were added to <Solution $A_3$> by simultaneous mixing method taking two minutes, to cause nucleation.

To <Solution $A_4$>, which was maintained at 60° C. and stirred vigorously in a reaction vessel, <Solution $B_4$> and <Solution $C_4$> were added by a controlled double-jet mixing method taking 107 minutes, during the addition pH and pAg of the solution were maintained at 5.8 and 8.7, respectively, the rate of the addition of <Solution $B_4$> and <Solution $C_4$> was increased linearly so that the rate at the time of completion was 6.4 times greater than that at the time of initiation.

After completion of the addition, for the purpose of removing surplus salts, precipitation desalination was carried out using an aqueous solution containing Demol, a product of Kao Atlas Co. Ltd. and an aqueous solution containing magnesium sulfite, to obtain a silver halide emulsion of which average silver iodide content, pH and pAg were about 2.0 mol 5.85 and 8.5, respectively at 40° C.

From electron microscopic observation, it was found that the silver halide emulsion thus obtained was an emulsion containing tabular-shaped tetradecahedral silver halide grains, of which average grain size, width of the grain size distribution and average aspect ratio were 0.98 μm, 15% and 4.5, respectively. Further, average ratio of distance between two twin planes (1) over the thickness of the tabular grain (t), i.e., t/1 was 11, surface of the crystal consisted of (111) plane and (100) plane. All the main planes consisted of (111) plane and ratio of (111) plane and (100) plane in the edge surface of the grain was 78:22.

After adjusting pH and pAg of the thus prepared emulsion were adjusted at 5.8 and 7.0, respectively using citric acid and sodium chloride, sensitizing dyes as shown in Table 2 were added, and after undergoing an optimum degree of chemical ripening at 60° C. with ammonium thiocyanate, sodium thiocyanate hexa-hydrate and auric chloride, the ripening was ceased by adding 1.0 g a mol of silver of 4-hydroxy-6-methyl-1,3,3a,7-tetrazaindene.

(preparation of a silver halide light-sensitive photographic material)

On one surface of a cellulose triacetate film support was subjected to subbing treatment and, then, on the opposite surface (rear surface) of the support, layers having the following compositions were provided in order from the side of the support.

| | |
|---|---|
| First Rear Layer: | |
| Alumina Sol AS-100 (Aluminium oxide, a product of Nissan Chemical Industry Co., Ltd.) | 0.8 g |
| Second Rear Layer: | |
| Diacetyl cellulose | 100 mg |
| Stearic acid | 10 mg |
| Fine powder of silica (average grain Size: 0.2 μm | 50 mg |

On the surface of a subbing-treated triacetate film support, layers, of which compositions are given below, were formed in order from the side of the support, to obtain light-sensitive color photographic materials (Sample Nos. 1 to 8) were prepared.

| | |
|---|---|
| First Layer: Anti-Halation Layer (HC) | |
| Black colloidal silver | 0.15 g |
| UV Absorbent (UV-1) | 0.20 g |
| Dye (CC-1) | 0.02 g |
| High Boiling-Point Solvent (Oil-1) | 0.20 g |
| High Boiling-Point Solvent (Oil-2) | 0.20 g |
| Gelatin | 1.6 g |
| Second Layer: Intermediate Layer (IL-1) | |
| Gelatin | 1.3 g |
| Third Layer: Silver Halide Emulsion Layer | |
| Silver Halide Emulsions C and D | 0.9 g |
| Sensitizing Dye (as shown in Table 2) | $3.4 \times 10^{-4}$ mols/mol of AgX |
| Magenta Dye-Forming Coupler (M-1) | 0.30 g |
| Magenta Dye-Forming Coupler (M-2) | 0.13 g |
| Colored Magenta Dye-Forming Coupler (CM-1) | 0.04 g |
| DIR Compound (D-1) | 0.004 g |
| High Boiling-Point Solvent (Oil-2) | 0.35 g |
| Gelatin | 1.0 g |
| Fourth Layer: First Protective Layer (Pro-1) | |
| Fine powder Silver iodobromide emulsion (average grain size: 0.08 μm) | 0.3 g |
| UV Absorbent (UV-1) | 0.07 g |
| UV Absorbent (UV-2) | 0.10 g |
| Additive 1 (HS-1) | 0.2 g |
| Additive 2 (HS-2 | 0.1 g |
| High Boiling Point Solvent (Oil-1) | 0.07 g |
| High Boiling Point Solvent (Oil-2) | 0.07 g |
| Gelatin | 0.8 g |
| Fifth Layer: Second protective Layer (Pro-2) | |
| Additive 3 (HS-3) | 0.04 g |
| Additive 4 (HS-4) | 0.004 g |
| Polymethyl methacrylate: Ethylacrylate (average grain diameter: 3 μm) | 0.02 g |
| Methyl methacrylate: Ethyl methacrylate: Methacrylic acid copolymer (3:3:4 weight ratio) (average grain Diameter: 3 μm) | 0.13 g |
| Gelatin | 0.5 g |

In addition, the above-mentioned coating samples further comprise surface active agents SA-2 and SA-3; a viscosity adjusting agent, stabilizers ST-3, ST-4 and ST-5; (average molecular weights of 10,000 and 1,100,000); Dyes F-4 and F-5 and an additive HS-5 (9.4 mg/m$^2$)

| | |
|---|---|
| Oil-1: | Dioctylphthalate |
| Oil-2: | Tricresylphosphate |
| Oil-3: | Dibutyl phthalate |
| HS-1: | Hydantoin |
| HS-2: | 4-ureido hydantoin |
| HS-4: | Sodium-(di-(2,2,3,3,4,4,5,5,6.6,7,7-dodecylfluoroheptyl)sulfosuccinate |
| SA-2: | Sodium tri-i-propyl-naphthalene sulfosuccinate |
| SA-3: | Sodium di-(2-ethylhexyl) sulfosuccinate |
| H-1: | Sodium 2,4-dichloro-6-hydroxy-s-triazine |
| H-2: | 1,2-bis((α-vinylsulfonylacetamide)ethane |
| ST-4: | 1-phenyl-5-mercapto tetrazole |
| ST-5: | poly-N-vinyl pyrrolidone |

UV-1

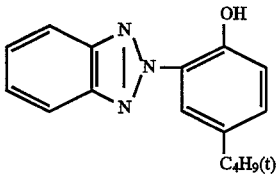

-continued
UV-2
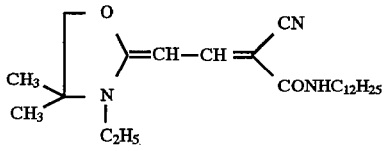
CC-1
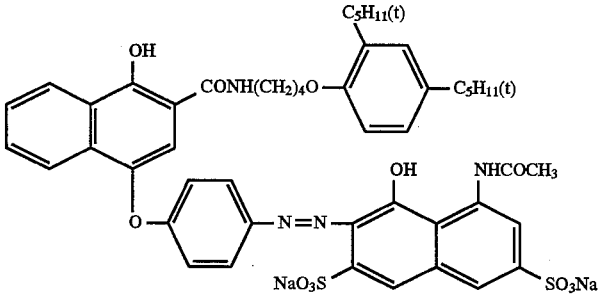
M-1
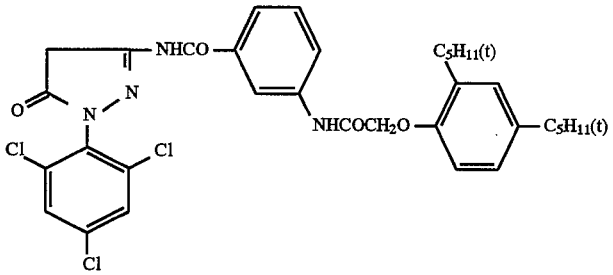
M-2
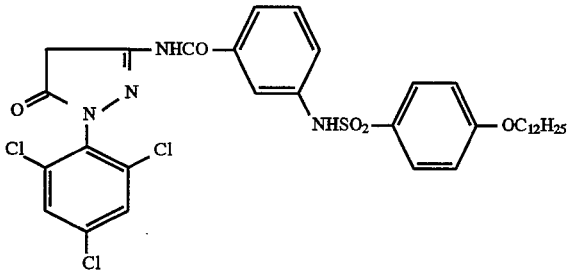
CM-1
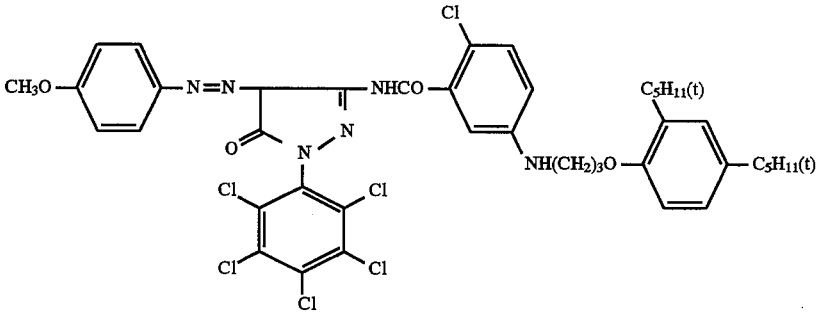

-continued

D-1

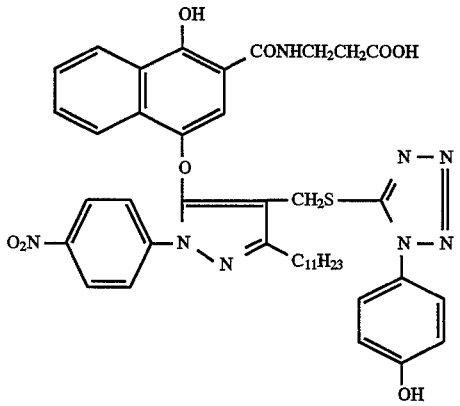

HS-3

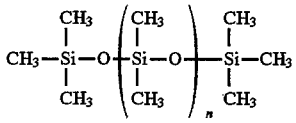

F-4

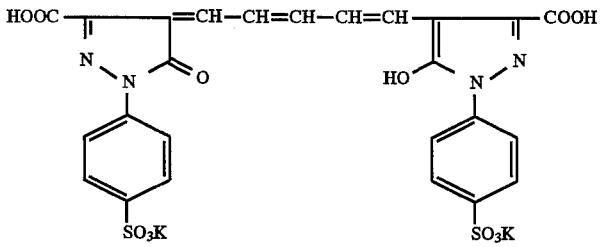

F-5

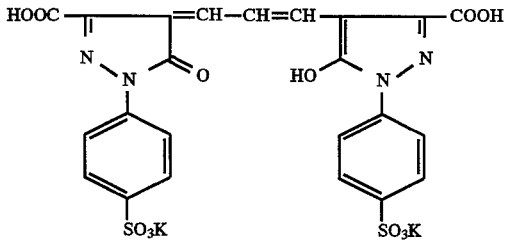

HS-5

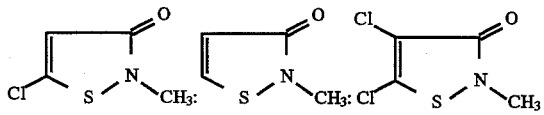

(50:46:4) mol ratio

Evaluation of Photographic Properties

Respective samples thus obtained were divided into two groups and one of the respective samples was placed in close touch with an optical wedge(Y-48, a product of Toshiba Glass Ltd.), through which the sample was subjected to exposure. With respect to the samples of another group, they were subjected to light exposure through a interference filter to light having its gravity center at 520 nm. These samples were, then, processed in a rapid processor SR-X-520, a product of Konica Corporation, in which a developing solution XD-SR and a fixing solution XF-SR, both produced by Konica Corporation, are installed. Thus obtained samples were subjected to density measurement in a conventional method using an optical densitometer PDA-65, a product of Konica corporation, to obtain relative sensitivities of the samples by calculating reciprocals of light exposure which gives the samples the fog density plus 0.3. Thus relative sensitivity of the respective samples were obtained, while sensitivity of Sample No. 13 was normalized as 100.

Moreover, degree of color stains due to residual dye was investigated by measuring the amount of remaining sensitizing dye by thin-layer chromatography, after condensed and extracted solution, which is a mixed solvent made of water and methanol and in which unexposed sample films, which have been subjected to development and fixing processes, were dipped for one hour in a dark room. Results were divided into five ranks, in which 5 is the highest, leaving no residual dye at all, to 1, which is worst.

Results are shown in Table 2.

(Processing Step)

| Step | Time | Temperature | Amount of replenishment* |
|---|---|---|---|
| Color Development | 3'15" | 38 ± 0.3° C. | 780 ml |
| Bleaching | 45" | 38 ± 2.0° C. | 150 ml |
| Fixing | 1'30" | 38 ± 2.0° C. | 830 ml |
| Stabilizing | 60" | 38 ± 5.0° C. | 830 ml |
| Drying | 60" | 55 ± 5.0° C. | — |

Note
*) amount a $m^2$ of the photographic material

<Compositions of processing Solutions>

(Developing solution)

| | |
|---|---|
| Water | 800 ml |
| Potassium carbonate | 30 g |
| Sodium hydrocarbonate | 2.5 g |
| Potassium sulfite | 3.0 g |
| Sodium bromide | 1.3 g |
| Potassium iodide | 1.2 mg |
| Hydroxylamine sulfate | 2.5 g |
| 4-Amino-3-ethyl-N-ethyl-N-(β-hydroxylethyl) aniline sulfate | 4.5 g |
| Diethylenetetramine penta-acetic acid | 3.0 g |
| Potassium hydroxide | 1.2 g |

Add water to make the total volume 1,0 liter and adjust pH with potassium hydroxide or 20% sulfuric acid at 10.06.

(Development Replenisher)

| | |
|---|---|
| Water | 800 ml |
| Potassium carbonate | 35 g |
| Sodium hydrocarbonate | 3.0 g |
| Potassium sulfite | 5.0 g |
| Sodium bromide | 0.4 g |
| Potassium iodide | 1.2 mg |
| Hydroxylamine sulfonic acid salt | 3.1 g |
| 4-Amino-3-ethyl-N-ethyl-N-(β-hydroxylethyl) aniline sulfonic acid salt | 6.3 g |
| Diethylenetetramine penta-acetic acid | 3.0 g |
| Potassium hydroxide | 2.0 g |

Add water to make the total volume 1.0 liter and adjust pH with potassium hydroxide or 20% sulfuric acid at 10.18.

(Bleaching Solution)

| | |
|---|---|
| Water | 700 ml |
| Ammonium ferric (III) 1,3-diaminopropane tetra acetate | 125 g |
| Ethylenediaminetetracetic acid | 2 g |
| Sodium nitrate | 40 g |
| Ammonium bromide | 150 g |

Add water to make the total volume 1.0 liter and adjusted pH with ammoniacal water or glacial acetic acid at 4.4

Bleaching Replenisher)

| | |
|---|---|
| Water | 700 ml |
| Ferric(III) ammonium 1,3-diaminopropane tetracetate | 175 g |
| Ethylenediaminetetracetic acid | 2 g |
| Sodium nitrate | 50 g |
| Ammonium bromide | 200 g |
| Glacial acetic acid | 58 g |

Add water to make the total volume 1.0 liter and adjust pH with ammoniacal water or glacial acetic acid at 4.0.

(Fixing Solution)

| | |
|---|---|
| Water | 800 ml |
| Ammonium thiocyanate | 120 g |
| Ammonium thiosulfate | 150 g |
| Sodium sulfite | 15 g |
| Ethylenediaminetetracetic acid | 2 g |

Add water to make the total volume 1.0 liter and adjust pH with ammoniacal water or glacial acetic acid at 6.2.

(Fixing Replenisher)

| | |
|---|---|
| Water | 800 ml |
| Ammonium thiocyanate | 150 g |
| Ammonium thiosulfate | 180 g |
| Sodium sulfite | 20 g |
| Ethylenediaminetetracetic acid | 2 g |

Add water to make the total volume 1.0 liter and adjust pH with ammoniacal water or glacial acetic acid at 6.5.

(Stabilizing Solution and a Replenisher thereof)

| | |
|---|---|
| Water | 900 ml |
| p-Octylphenol-ethylene oxide 10 mol additive | 2.0 g |
| Dimethylol urea | 0.5 g |
| Hexamethylene tetramine | 0.2 g |
| 1,2-Benzisothiazoline-3-one | 0.1 g |
| Siloxane (L-77, produced by UCC) | 0.1 g |
| Ammoniacal water | 0.5 ml |

Add water to make the total volume 1.0 liter and adjust pH with ammoniacal water or 50% sulfuric acid at 8.5.

TABLE 2

| Sample No. | Sensitizing Dye (**) | Relative Sensitivity: Green Filter | Relative Sensitivity: Interference Filter | Residual Dye Stain |
|---|---|---|---|---|
| 1 | I-1 | 93 | 125 | 4.5 |
| 2 | I-2 | 102 | 132 | 4.0 |
| 3 | I-9 | 87 | 110 | 4.5 |
| 4 | I-11 | 73 | 104 | 3.5 |
| 5 | A | 100 | 100 | 2.5 |
| 6 | B | 53 | 87 | 4.0 |
| 7 | C | 83 | 70 | 1.5 |
| 8 | D | 61 | 43 | 1.5 |

(**) Added amount is given in terms of $5.0 \times 10^{-4}$ mols a mol of silver As is obvious from Table 2, it is understood that the silver halide light-sensitive photographic material prepared according to the present invention has not only enhanced sensitivity to green light in comparison with the comparative samples but also higher sensitivity in the shorter wavelength region than that in the longer wavelength region of green light, which gives a favorable photographic property in the light of color reproduction. Further they are superior in the anti-staining property due to residual dye.

According to the present invention it is possible to provide a silver halide light-sensitive photographic material, of which spectral sensitivity in the short wavelength region of green light is enhanced and by which color staining due residual dye is reduced.

We claim:

1. A silver halide light-sensitive photographic material comprising a light-sensitive silver halide emulsion layer provided on a support, wherein the light-sensitive silver halide emulsion layer comprises a sensitizing dye represented by the general formula I:

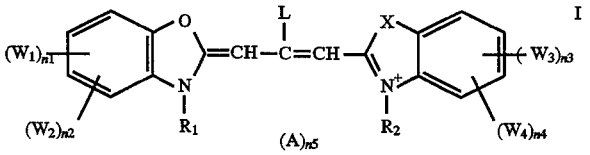

I wherein, $W_1$ is a fluorine-substituted alkyl group; $W_2$, $W_3$ and $W_4$ independently are a group selected from a group consisting of a fluorine free aliphatic group, an aromatic group, a halogen atom, an acylamino group carbamoyl group, a carboxyl group, a sulfonamide group and a sulfamoyl group;

$n_1$ is 1 or 2;

$n_2$, $n_3$ and $n_4$ are independently 0, 1 or 2;

$R_1$ and $R_2$ are an aliphatic group or an aromatic group which may be substituted, provided that they may be either same or different;

X is an oxygen atom or an alkyl-substituted nitrogen atom;

L is a hydrogen atom or an alkyl group;

A is a counter ion which is necessary to neutralize ion charge of the molecule; and $n_5$ represents zero or one.

2. The silver halide light-sensitive photographic material of claim 1, wherein X is an oxygen atom.

3. The silver halide light-sensitive photographic material of claim 1, wherein $W_1$ is $—CHF_2$, $—CF_3$, $—CF_2CHF_2$, $—C_3HF_6$ or $—C_3F_7$.

4. The silver halide light-sensitive photographic material of claim 3, wherein $W_1$ is a tri-fluoromethyl group.

5. The silver halide light-sensitive photographic material of claim 1, wherein $R_1$ and $R_2$ are an aliphatic group or an aromatic group having at least one sulfo group as a substituent.

6. The silver halide light-sensitive photographic material of claim 5, wherein $R_1$ and $R_2$ sulfoethyl group, sulfopropyl group, 3-sulfobutyl group, 4-sulfobutyl group, a or 2-hydroxy-3-sulfopropyl group.

7. The silver halide light-sensitive photographic material of claim 1, wherein X is an oxygen atom.

8. The silver halide light-sensitive photographic material of claim 1, wherein L is an ethyl group.

9. The silver halide light-sensitive photographic material of claim 1 wherein said sensitizing dye contains a maximum of one fluorine-substituted aliphatic group.

* * * * *